United States Patent [19]

Mey et al.

[11] 4,066,455

[45] Jan. 3, 1978

[54] SELENIUM CONTAINING MULTI-ACTIVE PHOTOCONDUCTIVE ELEMENT

[75] Inventors: William Mey; David S. Bailey, both of Rochester, N.Y.

[73] Assignee: Eastman Kodak Company, Rochester, N.Y.

[21] Appl. No.: 628,879

[22] Filed: Nov. 5, 1975

[51] Int. Cl.[2] ..... G03G 5/04

[52] U.S. Cl. ..... 96/1.5 R; 96/1.6

[58] Field of Search ..... 96/1.5, 1.6; 252/501

[56] References Cited

U.S. PATENT DOCUMENTS

| | | | |
|---|---|---|---|
| 3,591,374 | 7/1971 | Sens | 96/1.6 |
| 3,615,414 | 10/1971 | Light | 96/1.6 |
| 3,684,548 | 8/1972 | Contois | 96/1.5 X |
| 3,837,851 | 9/1974 | Shattuck et al. | 96/1.5 |
| 3,840,368 | 10/1974 | Ikeda et al. | 96/1.6 X |
| 3,879,199 | 4/1975 | Trubisky | 96/1.5 |
| 3,884,691 | 5/1975 | Rochlitz | 96/1.5 X |
| 3,953,207 | 4/1976 | Horgan | 96/1.5 X |
| 3,954,464 | 5/1976 | Karam et al. | 96/1.5 |

*Primary Examiner*—Roland E. Martin, Jr.
*Attorney, Agent, or Firm*—J. R. Everett

[57] ABSTRACT

A multi-active photoconductive element is disclosed having at least three layers in electrical contact with one another, said layers comprising a photoconductive selenium-containing layer, a charge-generation layer and an organic photoconductor-containing charge-transport layer. The charge-generation layer contains a continous polymeric phase having dispersed therein a co-crystalline complex composed of (i) at least one polymer having an alkylidene diarylene group in a recurring unit and (ii) at least one pyrylium-type dye salt. The multi-active element of the invention exhibits improved sensitivity to blue light.

7 Claims, No Drawings

SELENIUM CONTAINING MULTI-ACTIVE PHOTOCONDUCTIVE ELEMENT

FIELD OF THE INVENTION

This invention relates to electrophotography and particularly to an improved photoconductive element for use in various electrophotographic processes.

BACKGROUND OF THE INVENTION

Electrophotographic imaging processes and techniques have been extensively described in both the patent and other literature.

Various types of photoconductive insulating elements are known for use in electrophotographic imaging processes. In many conventional elements, the active components of the photoconductive insulating composition are contained in a single layer composition. This composition is typically affixed, for example, to a conductive support during the electrophotographic imaging process.

Among the many different kinds of photoconductive compositions which may be employed in typical single active layer photoconductive elements are inorganic photoconductive materials such as vacuum evaporated selenium, particulate zinc oxide dispersed in a polymeric binder, homogeneous organic photoconductive compositions composed of an organic photoconductor solubilized in a polymeric binder, and the like.

Another especially useful photoconductive insulating composition which may be employed in a single active layer photoconductive element are the high-speed "heterogeneous" or aggregate photoconductive compositions described in Light, U.S. Pat. No. 3,615,414 issued Oct. 26, 1971 and Gramza et al, U.S. Pat. No. 3,732,180 issued May 8, 1973. These aggregate-containing photoconductive compositions have a continuous electrically insulating polymer phase containing a finely-divided, particulate, co-crystalline complex of (i) at least one pyrylium-type dye salt and (ii) at least one polymer having an alkylidene diarylene group in a recurring unit.

Recently, an especially useful "multi-active," photoconductive insulating composition has been developed which contains a charge-generation layer in electrical contact with a charge-transport layer, the charge-generation layer comprising a multi-phase aggregate composition as described in U.S. Pat. No. 3,615,414 having a continuous, polymeric phase and dispersed in the continuous phase a co-crystalline complex of (i) a pyrylium-type dye salt, such as 2,4,6-substituted thiapyrylium dye salt, and (ii) a polymer having an alkylidene diarylene group as a repeating unit, and the charge-transport layer comprising an organic photoconductive charge-transport material. When a uniform-polarity electrostatic charge is applied to the surface of this multi-active element and the charge-generation layer thereof is subjected to an image wise exposure to activating radiation, the charge-generation layer generates charge carriers, i.e., electron-hole pairs, and injects them into the charge-transport layer which accepts and transports these charge carriers through the multi-active element to form an electrostatic charge pattern at or near the surface of the multi-active element corresponding to the imagewise exposure. The above-described, multi-active element is described in Berwick et al, copending U.S. Pat. application Ser. No. 534,979, filed Dec. 20, 1974 now abandoned continuation-in-part in U.S. Ser. No. 639,039 filed Dec. 9, 1975.

In addition to the above-described "multi-active" photoconductive composition, another useful type of multi-active photoconductive element has been recently developed. This latter multi-active element is described in Mey, U.S. Serial No. 534,978 filed Dec. 20, 1974 now abandoned continuation-in-part in U.S. Ser. No. 641,058 filed Dec. 15, 1975 and contains a multi-phase aggregate composition as described hereinbabove and in Light, U.S. Pat. No. 3,615,414 in electrical contact with an inorganic photoconductive composition, such as selenium.

Each of the above-described multi-active elements have provided distinct advantages over the prior art. For example, the multi-active element described in Berwick et. al., U.S. Ser. No. 534,979 provides, in its preferred embodiments, substantially higher electrical speeds than can be obtained by conventional, single layer aggregate photoconductive compositions as described in Light, U.S. Pat. No. 3,615,414. And, the multi-active element described in Mey, U.S. Ser. No. 534,978, in certain embodiments thereof which employ selenium in the inorganic photoconductor-containing layer, provides improved blue sensitivity over that which can normally be obtained by a conventional, single layer aggregate photoconductive element as described in Light, U.S. Pat. No. 3,615,414.

There remains, however, the problem that many of the high speed multi-active photoconductive compositions of the type described in Berwick et. al. exhibit less than the desired sensitivity to light in the blue region of the spectrum, i.e., light in the range of from about 400 to 560 nm.

SUMMARY OF THE INVENTION

In accord with the present invention it has been found that an improved multi-active photoconductive element of the type described in the above-identified Berwick et. al. application can be provided by incorporating a photoconductive selenium-containing layer therein.

Accordingly, the multi-active photoconductive elements used in the present invention have at least three active layers in electrical contact with one another, the three active layers comprising a photoconductive selenium-containing layer, an aggregate charge-generation layer, and a charge-transport layer containing an organic photoconductive charge-transport material.

DESCRIPTION OF THE PREFERRED EMBODIMENTS

As a result of the present invention one can advantageously modify certain of the multi-active photoconductive elements as described in the above-identified Berwick et. al. patent application and thereby significantly enhance the photosensitivity of the resultant multi-active elements to blue light. That is, one of the especially useful embodiments of the multi-active photoconductive elements described in the aforementioned Berwick et. al. application contains a charge-transport layer which is transparent and therefore not photoresponsive to visible light (i.e. light in 400 to 700 nm. wavelength range) and a charge-generation layer which, unless modified by the incorporation of a separate blue light sensitive component, is photosensitive to light outside the blue wavelength range, i.e. light having a wavelength in the range of about 400 to about 560 nm.

Accordingly, in the foregoing embodiment of the Berwick et. al. multi-active element, it is particularly useful to incorporate therein a selenium-containing photoconductive layer, which, by virtue of its selenium content, is sensitive to blue light in the 400–560 nm. wavelength range.

The selenium-containing photoconductive layer used in the present invention may be composed of any of several different types of selenium photoconductive layers. For example, the selenium-containing layer may be composed of a thin vacuum-deposited selenium with or without various sensitizing dopants such as tellurium, arsenic, antimony, etc. Such vacuum-deposited selenium-containing layers are especially preferred for use in the present invention because of their excellent sensitivity to blue light. Such layers may be formed by vacuum-deposition techniques well-known in the art and therefore extended discussion thereof is unnecessary herein. Such layers are typically quite thin having a thickness, for example, in the range of from about 0.001 to about 3 microns.

As explained previously herein, the multi-active photoconductive elements in which the selenium-containing photoconductive layer as described above are incorporated represent a type of multi-active photoconductive element within the class of multi-active elements described in Berwick et. al., copending U.S. application Ser. No. 534,979, referred to above and incorporated herein by reference thereto. Such multi-active photoconductive elements are unitary, multi-layer elements having at least two layers, namely a charge-generation layer in electrical contact with a charge-transport layer. The charge-generation layer is composed of a multiphase "aggregate" composition of the type described in Light, U.S. Pat. No. 3,615,414. The charge-generation layer, therefore, contains a continuous electrically insulating, polymer phase and, dispersed in the continuous phase, a discontinuous phase comprising a finely-divided, particular, co-crystalline complex of (i) at least one polymer having an alkylidene diarylene group in a recurring unit and (ii) at least one pyrylium-type dye salt such as a pyrylium, thiapyrylium, or a selenapyrylium dye salt, the thiapyrylium dye salts being especially useful. In addition, if desired and in accord with especially advantageous embodiments of the present invention, one or more organic photoconducting charge transport materials may also be incorporated in the charge-generation layer, preferably in solid solution with the continuous phase thereof. Additional information concerning the use of such organic photoconducting charge-transport materials in the charge-generation layer is contained hereinafter.

As noted earlier herein, the selenium-containing photoconductive layer used in the present invention is in electrical contact with the other active layers of the multi-active element of the invention, namely the charge transport layer and the aggregate charge-generation layer. Typically, the multi-active elements of the invention contain the three active layers temporarily or permanently affixed to a conductive support. In such a multilayer structure, the physical arrangement of the active layers with respect to the conductive support can be widely varied. For example, any one of the selenium-containing photoconductor layer, the aggregate charge-generation layer, or the organic-photoconductor-containing charge-transport layer may be immediately adjacent to the conductive support. The positioning of the remaining two active layers on top of whichever layer is placed immediately adjacent the conductive support can likewise be varied. In general, it has been found that best results are usually obtained when the aggregate charge-generation layer is sandwiched between the selenium-containing photoconductor layer and the organic photoconductor-containing charge-transport layer. Additional description relating to the conductive support which may be employed together with the multi-active element of the invention is set forth hereinafter.

The charge-transport layer of the aforementioned multiactive, photoconductive insulating element is free of the particulate, co-crystalline-complex material and the pyrylium-type dye salts contained in the charge-generation layer described above. Typically, the charge-transport layer contains a film-forming polymer in addition to one or more charge-transport materials. Preferably, although not necessarily, the charge-transport material(s) has a principal radiation absorption band below about 475 nm and is transparent to activating radiation for the charge-generation layer.

The charge-transport layer used in the multi-active element of the present invention typically contains an organic material-containing composition. The term "organic", as used herein, refers to both organic and metallo-organic materials.

The charge-transport layer used in the present invention contains as the active charge-transport material one or more p-type organic photoconductors capable of accepting and transporting charge carriers generated by the charge-generation layer. The charge-transport layer is free of the above-mentioned co-crystalline complex and any pyrylium-type dye salt. Useful charge-transport materials can generally be divided into two classes depending upon the electronic charge-transport properties of the material. That is, most charge-transport materials generally will preferentially accept and transport either positive charges, i.e. holes, or negative charges, i.e. electrons, generated by the charge-generation layer. Of course, there are many materials which will accept and transport either positive charges or negative charges; however, even these "amphoteric" materials generally, upon closer investigation, will be found to possess at least a slight preference for the conduction of either positive charge carriers or negative charge carriers.

Those materials which exhibit a preference for the conduction of positive charge carriers are referred to herein as "p-type" charge-transport materials, and these are the materials which are employed as the charge transport materials in the multi-active elements of the present invention.

The capability of a given organic photoconductor to accept and transport charge carriers generated by the charge-generation layer used in the multi-active elements of the invention can be conveniently determined by coating a layer of the particular organic photoconductor under consideration for use as a charge-transport material (e.g. a 5 to 10 micron thick layer containing about 30 weight percent or more of the organic photoconductive material together with up to about 70 weight percent of a binder, if one is used), on the surface of a charge-generation layer (e.g., a 0.5 to 2 micron aggregate charge-generation layer such as that described more specifically in Example 1 hereinafter) which is, in turn, coated on a conducting substrate. The resultant unitary element may then be subjected to a conventional electrophotographic processing sequence including (a) applying a uniform electrostatic charge to the surface of the layer to be tested for charge-transport properties in the absence of activating radiation while the conducting substrate is maintained at a suitable reference potential thereby creating a potential difference, $V_o$, across the element of, for example, about ± 200–600 volts, (b) exposing the charge-generation layer of the resultant element to activating radiation, for example, 680 nm. light energy of 20 ergs/cm.$^2$, and (c) determining the change in the magnitude of the charge initially applied to the element caused by the exposure to activating radiation, i.e., calculating the change in potential difference, $\Delta.^V$, across the element as a result of the exposure. If the particular organic photoconductor under consideration as a charge-transport material possesses no charge-transport capability, then the ratio of the quantity $V_o$ to the quantity $V_o - \Delta V$, i.e., the ratio $V_o : (V_o - \Delta V)$, will, to a good approximation, equal the ratio of the sum of the physical thicknesses of the charge-transport layer, $T_{ct}$, and the charge-generation layer, $T_{cg}$, to the physical thickness of the charge-generation layer by itself (i.e. $T_{cg}$), i.e., the ratio $(T_{ct} + T_{cg}) : T_{cg}$. That is, $V_o:(V_o - \Delta V) \simeq (T_{ct} + T_{cg}) : T_{cg}$. If, on the other hand, the particular organic photoconductor under consideration possesses charge-transport capability then the ratio $V_o:(V_o - \Delta V)$ will be greater than the ratio $$(T_{ct} + T_{cg}) : T_{cg}, \text{ i.e., } V_o:(V_o - \Delta V) > (T_{ct} + T_{cg}) : T_{cg}.$$

If, as is often the case, a binder is employed in the charge-transport layer when the above-described charge-transfer determination is made, care should be taken to account for any charge-transport capability exhibited by the charge-transport layer which may be imparted solely by the binder, rather than by the particular organic photoconductor being evaluated. For example, certain polymeric materials, particularly certain aromatic- or heterocyclic-group-containing polymers have been found to be capable of accepting and transporting at least some of the charge carriers which are injected to it by an adjacent charge-generation layer. For this reason, it is advantageous when evaluating various organic photoconductor materials for charge-transport properties to employ a binder, if one is needed or desired, which exhibits little or no charge-transport capability with respect to charge carriers generated by the charge-generation layer of the present invention, for example, a poly(styrene)polymer.

Among the organic photoconductors which have been found especially preferred as charge-transport materials in the present invention are materials wholly or partially transparent to, and therefore insensitive or substantially insensitive to, the activating radiation used in the present invention. Accordingly, if desired, exposure of the charge-generation layer can be effected by activating radiation which passes through the charge-transport layer before impinging on the generation layer. The organic photoconductors preferred for use as charge-transport materials in the charge-transport layer do not, in fact, function as photoconductors in the present invention because such materials are insensitive to activating radiation and, therefore, do not generate electron-hole pairs upon exposure to activating radiation; rather, these materials serve to transport the charge carriers generated by the charge-generation layer. In most cases, the charge-transport materials which are prepared for use in a multi-active element of the invention which is sensitive to visible light radiation are organic photoconductors whose principal absorption band lies in a region of the spectrum below about 475 nm. and preferably below about 400 nm. The phrase "organic photoconductors whose principal absorption band is below about 400 nm." refers herein to photoconductors which are both colorless and transparent to visible light, i.e., do not absorb visible light. Those materials which exhibit little or no absorption above 475 nm. but do exhibit some absorption of radiation in the 400 to 475 nm. region will exhibit a yellow coloration but will remain transparent to visible light in the 475 to 700 nm. region of the visible spectrum.

Of course, where the charge-generation layer of the multi-active element of the invention is exposed to activating radiation without having to expose through the charge-transport layer, it is possible to use organic photoconductive materials in the charge-transport layer which are highly colored or opaque.

Another useful criteria which has been found helpful in characterizing those charge-transport materials which seem to operate most effectively in the multi-active element of the invention is the finding that, to date, the more useful charge-transport materials are organic photoconductive materials which exhibit a hole or electron drift mobility greater than about $10^{-9}$ cm.$^2$/volt-sec., preferably greater turn about $10^{-6}$cm$^2$/volt-sec.

Having regard to the foregoing information relating to useful p-type charge-transport materials to be employed in the multi-active elements of the present invention, it is understood that any of a wide variety of such materials may be used. A partial listing of representative p-type charge-transport materials is included hereinafter.

1. certain arylamine-containing materials including certain monoarylamines, diarylamines, triarylamines, as well as polymeric arylamines. A partial listing of specific, useful arylamine organic photoconductors include certain of the particular non-polymeric triphenylamines illustrated in Klupfel et.al., U.S. Pat. No. 3,180,730 issued Apr. 27, 1965; the polymeric triarylamines described in Fox U.S. Pat. No. 3,240,597 issued Mar. 15, 1966; the triarylamines having at least one of the aryl radicals substituted by either a vinyl radical or a vinylene radical having at least one active hydrogen-containing group as described in Brantly et.al., U.S. Pat. No. 3,567,450 issued Mar. 2, 1971; the triarylamines in which at least one of the aryl radicals is substituted by an active hydrogen-containing group as described in Brantly et. al. U.S. Pat. No. 3,658,520 issued Apr. 25, 1972; tritolylamine; certain of the $\alpha,\alpha'$-bis(aminobenzylidene)arylidacetonitriles described in Merrill, U.S. Pat. No. 3,653,887 issued Apr. 4, 1972; and certain of the materials described in Contois et. al., U.S. Pat. No. 3,873,312 issued Mar. 25, 1975 which have a central divalent aromatic ring joined to two amino-substituted styryl groups through the vinylene linkage of the styryl groups;

2. certain polyarylalkane materials of the type described in Noe et. al., U.S. Pat. No. 3,274,000 issued Sept. 20, 1966; Wilson; U.S. Pat. No. 3,542,547 issued Nov. 24, 1970; Seus et. al., U.S. Pat. No. 3,542,544 issued Nov. 24, 1970, and in Rule et. al., U.S. Pat. No. 3,615,402 issued Oct. 26, 1971. Preferred polyarylalkane photoconductors can be represented by the formula:

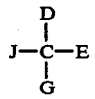

wherein J and E represent a hydrogen atom, an aryl group, or an alkyl group and D and G represent substituted aryl groups having as a substituent thereof a group represented by the formula:

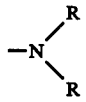

wherein R represents an alkyl substituted aryl such as a tolyl group.

3. other useful p-type charge-transport materials which may be employed in the present invention are any of the p-type organic photoconductors, including metallo-organo materials, which meet the aforementioned criteria and which are useful in electrophotographic processes.

As noted earlier herein, in accord with an especially preferred embodiment of the present invention, the organic photoconductive materials useful herein as charge-transport materials are advantageously those materials which exhibit little or no photosensitivity to radiation within the wavelength range to which the charge-generation layer is sensitive, i.e., radiation which causes the charge-generation layer to produce electron-hole pairs. Thus, in accord with a preferred embodiment of the invention wherein the multi-active element of the invention is to be exposed to visible electromagnetic radiation, i.e., radiation within the range of from about 400 to about 700 nm., and wherein the charge-generation layer contains a co-crystalline complex of the type described in greater detail hereinafter which is sensitive to radiation within the range of from about 520 nm. to about 700 nm.; it is advantageous to select as the organic photoconductive material to be used in the charge-transport layer, an organic material which is photosensitive to light outside the 520–700 nm. region of the spectrum, preferably in the spectral region below about 475 nm. and advantageously below about 400 nm.

The charge-transport layer may consist entirely of the charge-transport materials described hereinabove, or, as is more usually the case, the charge-transport layer may contain a mixture of the charge-transport material in a suitable film-forming polymeric binder material. The binder material may, if it is an electrically insulating material, help to provide the charge-transport layer with electrical insulating characteristics, and it also serves as a film-forming material useful in (a) coating the charge-transport layer, (b) adhering the charge-transport layer to an adjacent substrate, and (c) providing a smooth, easy to clean, and wear resistant surface. Of course, in instances where the charge-transport material may be conveniently applied without a separate binder, for example, where the charge-transport material is itself a polymeric material, such as a polymeric arylamine, there may be no need to use a separate polymeric binder. However, even in many of these cases, the use of a polymeric binder may enhance desirable physical properties such as adhesion, resistance to cracking, etc.

Where a polymeric binder material is employed in the charge-transport layer, the optimum ratio of charge-transport material to binder material may vary widely depending on the particular polymeric binder(s) and particular charge-transport material(s) employed. In general, it has been found that, when a binder material is employed, useful results are obtained wherein the amount of active charge-transport material contained within the charge-transport layer varies within the range of from about 5 to about 90 weight percent based on the dry weight of the charge-transport layer.

A partial listing of representative materials which may be employed as binders in the charge-transport layer are film-forming polymeric materials having a fairly high dielectric strength and good electrically insulating properties. Such binders include styrene-butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene; isobutylene polymers; polyesters, such as poly[ethylene-co-alkylenebis(alkyleneoxyaryl) phenylenedicarboxylate]; phenolformaldehyde resins; ketone resins; polyamides; polycarbonates, polythiocarbonates; poly[ethylene-co-isopropylidene-2,2-bis(ethyleneoxyphenylene)-terephthalate]; copolymers of vinyl haloarylates and vinyl acetate such as poly(vinyl-m-bromobenzoate-co-vinyl acetate); chlorinated poly(olefins), such as chlorinated poly(ethylene); etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable resins of the type contemplated for use in the charge transport layers of the invention are sold under such tradenames as VITEL PE-101, CYMAC, Piccopale 100, Saran F-220, and LEXAN 145. Other types of binders which can be used in charge transport layers include such materials as paraffin, mineral waxes, etc, as well as combinations of binder materials.

In general, it has been found that non-polar polymers containing aromatic or heterocyclic groups are most effective as the binder materials for use in the charge-transport layers because these polymers, by virtue of their molecular structure, tend to provide little or no interference with the transport of charge carriers through the layer. Heterocyclic or aromatic-containing polymers which are especially useful in p-type charge-transport layers include styrene-containing polymers, bisphenol-A polycarbonate polymers, phenol-formaldehyde resins, polyesters such as poly[ethylene-co-isopropylidene-2,2-bis(ethyleneoxyphenylene)] terephthalate, and copolymers of vinyl haloarylates and vinylacetate such as poly(vinyl-m-bromobenzoate-co-vinyl acetate).

The charge-transport layer may also contain other non-interfering addenda such as leveling agents, surfactants, plasticizers, and the like to enhance or improve various physical properties of the charge-transport layer.

The thickness of the charge-transport layer may vary. It is especially advantageous to use a charge-transport layer which is thicker than that of the charge-generation layer, with best results generally being obtained when the charge-transport layer is from about 5 to about 200 times, and particularly 10 to 40 times, as thick as the charge-generation layer. A useful thickness for the charge-generation layer is within the range of from about 0.1 to about 15 microns dry thickness, particularly from about 0.5 to about 2 microns. However, as indicated hereinafter, good results can also be obtained using a charge-transport layer which is thinner than the charge-generation layer.

The charge-transport layers described herein are typically applied to the desired substrate by coating a liquid dispersion or solution containing the charge-transport layer components. Typically, the liquid coating vehicle used is an organic vehicle. Typical organic coating vehicles include 1. Aromatic hydrocarbons such as benzene, naphthalene, etc., including substituted aromatic hydrocarbons such as toluene, xylene, mesitylene, etc.;
2. Ketones such as acetone, 2-butanone, etc.;
3. Halogenated aliphatic hydrocarbons such as methylene chloride, chloroform, ethylene chloride, etc.;
4. Ethers including cyclic ethers such as tetrahydrofuran, ethylether;
5. Mixtures of the above.

The charge-generation layer used in the present invention comprises a layer of the heterogeneous or aggregate composition as described in Light, U.S. Pat. No. 3,615,414 issued Oct. 26, 1971. These aggregate compositions have a multi-phase structure comprising (a) a discontinuous phase of at least one particulate co-crystalline compound or complex of a pyrylium-type dye salt and an electrically insulating, film-forming polymeric material containing an alkylidene diarylene group as a recurring unit and (b) a continuous phase comprising an electrically insulating film-forming polymeric material. Optionally, one or more charge-transport material(s) may also be incorporated in this multi-phase structure. Of course, these multi-phase compositions may also contain other addenda such as leveling agents, surfactants, plasticizers, and the like to enhance or improve various physical properties of the charge-generation layer.

The aggregate charge-generation composition may be prepared by several techniques, such as, for example, the so-called "dye first" technique described in Gramza et. al., U.S. Pat. No. 3,615,396 issued Oct. 26, 1971. Alternatively, these compositions may be prepared by the so-called "shearing" method described in Gramza, U.S. Pat. No. 3,615,415 issued Oct. 26, 1971. Still another method of preparation involves preforming the finely-divided aggregate particles such as is described in Gramza et. al., U.S. Pat. No. 3,732,180 and simply storing these preformed aggregate particles until it is desired to prepare the charge-generation layer. At this time, the preformed aggregate particles may be dispersed in an appropriate coating vehicle together with the desired film-forming polymeric material and coated on a suitable substrate to form the resultant aggregate charge-generation composition.

In any case, by whatever method prepared, the aggregate composition exhibits a separately identifiable multi-phase structure. The heterogeneous nature of this multi-phase composition is generally apparent when viewed under magnification, although such compositions may appear to be substantially optically clear to the naked eye in the absence of magnification. There can, of course, be microscopic heterogeneity. Suitably, the co-crystalline complex particles present in the continuous phase of the aggregate composition are finely-divided, that is, typically predominantly in the size range of from about 0.01 to about 25 microns.

The terms "co-crystalline complex" or "co-crystalline compound" are used interchangeably herein and have reference to a co-crystalline compound which contains dye and polymer molecules co-crystallized in a single crystalline structure to form a regular array of molecules in a three-dimensional pattern. It is this particulate co-crystalline material dispersed in the continuous polymer phase of the aggregate charge-generation layer which, upon being exposed to activating radiation in the presence of an electric field, generates electron-hole pairs in the multi-active photoconductive elements of the present invention.

Another feature characteristic of conventional heterogeneous or aggregate compositions such as those described in U.S. Pat. No. 3,615,414 and U.S. Pat. No. 3,732,180 is that the wavelength of the radiation absorption maximum characteristic of such compositions is substantially shifted from the wavelength of the radiation absorption maximum of a substantially homogeneous dye-polymer solid solution formed of similar constituents. The new absorption maximum characteristic of the aggregate composition is not necessarily an overall maximum for the system as this will depend on the relative amount of dye in the aggregate. The shift in absorption maximum which occurs due to the formation of the co-crystalline complex in conventional aggregate compositions is generally of the magnitude of at least about 10 nanometers.

As suggested earlier herein, those charge-generation layers which have been found especially advantageous for use in those embodiments of the invention relating to visible light sensitive multi-active elements are charge-generation layers containing a particulate aggregate material having its principal absorption band of radiation in the visible region of the spectrum within the range of from about 520 nm. to about 700 nm.

The pyrylium type dye salts useful in preparing the co-crystalline complex contained in the charge-generation layer of the present invention includes pyrylium, bispyrylium, thiapyrylium, and selenapyrylium dye salts; and also salts of pyrylium compounds containing condensed ring systems such as salts of benzopyrylium and napthopyrylium dyes are useful in forming such compositions. Typical pyrylium-type dye salts from these classes which are useful in forming these co-crystalline complexes are disclosed in Light, U.S. Pat. No. 3,615,414 noted above.

Particularly useful pyrylium-type dye salts which may be employed in forming the co-crystalline complex are salts having the formula:

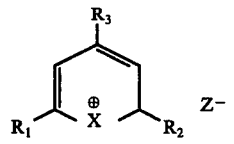

wherein:

$R_1$ and $R_2$ can each be phenyl groups, including substituted phenyl groups having at least one substituent chosen from alkyl groups of from 1 to about 6 carbon atoms and alkoxy groups having from 1 to about 6 carbon atoms;

$R_3$ can be an alkylamino-substituted phenyl group having from 1 to 6 carbon atoms in the alkyl group, and including dialkylamino-substituted and haloalkylamino-substituted phenyl groups;

X can be an oxygen, selenium, or a sulfur atom; and $Z^-$ is an anionic function, including such anions as perchloride, fluoroborate, iodide, chloride, bromide, sulfate, periodate, p-toluenesulfonate, hexafluorophosphate, and the like.

The film-forming polymer used in forming the co-crystalline complex contained in the charge-generation layer used in the present invention may include any of a variety of film-forming polymeric materials which are electrically insulating and have an alkylidene diarylene group in a recurring unit such as those linear polymers, including copolymers, containing the following group in a recurring unit:

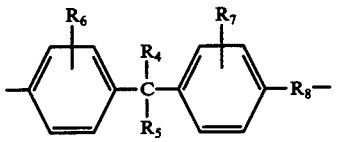

wherein:

$R_4$ and $R_5$, when taken separately, can each be a hydrogen atom, an alkyl group having from one to about 10 carbon atoms such as methyl, ethyl, isobutyl, hexyl, heptyl, octyl, nonyl, decyl, and the like including substituted alkyl groups such as trifluoromethyl, etc., and an aryl group such as phenyl and naphthyl, including substituted aryl groups having such substituents as a halogen atom, an alkyl group of from 1 to about 5 carbon atoms, etc.; and $R_4$ and $R_5$, when taken together, can represent the carbon atoms necessary to complete a saturated cyclic hydrocarbon group including cycloalkanes such as cyclohexyl and polycycloalkanes such as norbornyl, the total number of carbon atoms in $R_4$ and $R_5$ being up to about 19;

$R_6$ and $R_7$ can each be hydrogen, an alkyl group of from 1 to about 5 carbon atoms, e.g., or a halogen such as chloro, bromo, iodo, etc.; and $R_8$ is a divalent group selected from the following:

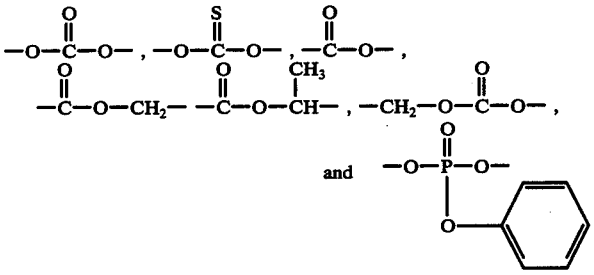

Polymers especially useful in forming the aggregate crystals are hydrophobic carbonate polymers containing the following group in a recurring unit:

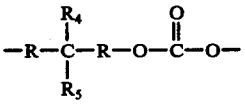

wherein:

Each R is a phenylene group including halo substituted phenylene groups and alkyl substituted phenylene groups; and $R_4$ and $R_5$ are as described above. Such compositions are disclosed, for example, in U.S. Pat. Nos. 3,028,365 and 3,317,466. Preferably polycarbonates containing an alkylidene diarylene moiety in the recurring unit such as those prepared with Bisphenol A and including polymeric products of ester exchange between diphenylcarbonate and 2,2-bis-(4-hydroxyphenyl)propane are useful in the practice of this invention. Such compositions are disclosed in the following U.S. Pat. Nos: U.S. Pat. No. 2,999,750 by Miller et. al., issued Sept. 12, 1961; 3,038,874 by Laakso et. al., issued June 12, 1962; 3,038,879 by Laakso et. al., issued June 12, 1962; 3,038,880 by Laakso et. al., issued June 12, 1962; 3,106,544 by Laakso et. al., issued Oct. 8, 1963; 3,106,545 by Laakso et. al., issued Oct. 8, 1963, and 3,106,546 by Laakso et. al., issued Oct. 8, 1963. A wide range of film-forming polycarbonate resins are useful, with completely satisfactory results being obtained when using commercial polymeric materials which are characterized by an inherent viscosity of about 0.5 to about 1.8.

The following polymers of Table A are included among the materials useful in the practice of this invention:

TABLE A

| Number: | Polymeric material |
|---|---|
| 1 | Poly(4-4'-isopropylidenediphenylene-co-1-4-cyclohexylenedimethylene carbonate). |
| 2 | Poly(ethylenedioxy-3,3'-phenylene thiocarbonate). |
| 3 | Poly(4,4'-isopropylidenediphenylene carbonate-co-terephthalate). |
| 4 | Poly(4-4'-isopropylidenediphenylene carbonate). |
| 5 | Poly(4,4'-isopropylidenediphenylene thiocarbonate). |
| 6 | Poly(4,4'-sec-butylidenediphenylene carbonate). |
| 7 | Poly(4,4'-isopropylidenediphenylene carbonate-block-oxyethylene). |
| 8 | Poly(4,4'-isopropylidenediphenylene carbonate-block-oxytetramethylene). |
| 9 | Poly[4,4'-isopropylidenebis(2-methylphenylene)-carbonate]. |
| 10 | Poly(4,4'-isopropylidenediphenylene-co-1,4-phenylene carbonate). |
| 11 | Poly(4,4'-isopropylidenediphenylene-co-1,3-phenylene carbonate). |
| 12 | Poly(4,4'-isopropylidenediphenylene-co-4,4'-diphenylene carbonate). |
| 13 | Poly(4,4'-isopropylidenediphenylene-co-4,4'-oxydiphenylene carbonate). |
| 14 | Poly(4,4'-isopropylidenediphenylene-co-4,4'-carbonyldiphenylene carbonate). |
| 15 | Poly(4,4'-isopropylidenediphenylene-co-4,4'-ethylenediphenylene carbonate). |
| 16 | Poly[4,4'-methylenebis(2-methylphenylene)carbonate]. |
| 17 | Poly[1,1-(p-bromophenylethylidene)bis(1,4-phenylene)carbonate]. |
| 18 | Poly[4,4'-isopropylidenediphenylene-co-4,4-sulfonyldiphenylene)carbonate]. |
| 19 | Poly[4,4'-cyclohexylidene(4-diphenylene) carbonate]. |
| 20 | Poly[4,4'-isopropylidenebis(2-chlorophenylene) carbonate]. |
| 21 | Poly(4,4'-hexafluoroisopropylidenediphenylene carbonate). |
| 22 | Poly(4,4'-isopropylidenediphenylene 4,4'-isopropylidenedibenzoate). |
| 23 | Poly(4,4'-isopropylidenedibenzyl 4,4'-isopropylidenedibenzoate). |
| 24 | Poly[4,4'-(1,2-dimethylpropylidene)diphenylene carbonate]. |
| 25 | Poly[4,4' -(1,2,2-trimethylpropylidene)diphenylene carbonate]. |
| 26 | Poly{4,4'-[1-(α-naphthyl)ethylidene]diphenylene carbonate}. |
| 27 | Poly[4,4'-(1,3-dimethylbutylidene)diphenylene carbonate]. |
| 28 | Poly[4,4'-(2-norbornylidene)diphenylene carbonate]. |
| 29 | Poly[4,4'-(hexahydro-4,7-methanoindan-5- |

TABLE A-continued

| Number: | Polymeric material |
|---|---|
| | ylidene)diphenylene carbonate]. |

The film-forming electrically insulating polymeric material used in forming the continuous phase of the aggregate charge-generation layer of the present invention may be selected from any of the above-described polymers having an alkylidene diarylene group in a recurring unit. In fact, best results are generally obtained when the same polymer is used to form the co-crystalline complex and used as the matrix polymer of the continuous phase of the aggregate composition. This is especially true when the aggregate particles are formed in situ as the aggregate composition is being formed or coated such as described in the so-called "dye-first" or "shearing" methods described above. Of course, where the particulate co-crystalline complex is preformed and then later admixed in the coating dope which is used to coat the aggregate composition, it is unnecessary for the polymer of the continuous phase to be identical to the polymer contained in the co-crystalline complex itself. In such case, other kinds of film-forming, electrically insulating materials which are well-known in the polymeric coating art may be employed. However, here to it is often desirable to use a film-forming electrically insulating polymer which is structurally similar to that of the polymer contained in the co-crystalline complex so that the various constituents of the charge-generation layer are relatively compatible with one another for purposes of, for example, coating. If desired, it may be advantageous to incorporate other kinds of electrically insulating film-forming polymers in the aggregate coating dope, for example, to alter various physical or electrical properties, such as adhesion, of the aggregate charge-generation layer.

The amount of the above-described pyrylium type dye salt used in the aggregate charge-generation layer may vary. Useful results are obtained by employing the described pyrylium-type dye salts in amounts of from about 0.001 to about 50 percent based on the dry weight of the charge-generation layer. When the charge-generation layer also has incorporated therein one or more charge-transport materials, useful results are obtained by using the described dye salts in amounts of from about 0.001 to about 30 percent by weight based on the dry weight of the charge-generation layer, although the amount used can vary widely depending upon such factors as individual dye salt solubility, the polymer contained in the continuous phase, additional charge transport materials, the electrophotographic response desired, the mechanical properties desired, etc. Similarly, the amount of dialkylidene diarylene group-containing polymer used in the charge-generation layer of the multi-active elements of the invention may vary. Typically, the charge-generation layer contains an amount of this polymer within the range of from about 20 to about 98 weight percent based on the dry weight of the charge-generation layer, although larger or smaller amounts may also be used.

As noted above, it has been found advantageous to incorporate one of more p-type charge-transport materials in the aggregate composition. Especially useful such materials are organic, including metallo-organic, materials which can be solubilized in the continuous phase of the aggregate composition. By employing these materials in the aggregate composition, it has been found that the resultant sensitivity of the multi-active photoconductive element of the present invention can be enhanced. Although the exact reason for this enhancement is not completely understood, it is believed that the charge-transport material solubilized in the continuous phase of the charge-generation layer aids in transporting the charge carriers generated by the particulate co-crystalline complex of the charge-generation layer to the charge-transport layer and thereby prevents recombination of the charge carriers, ie., the electron-hole pairs, in the charge-generation layer.

The kinds of charge-transport materials which may be incorporated in the charge-generation layer include any of the charge-transport materials described above for use in the charge-generation layer. As is the case with charge-transport layer, if a charge-transport material is incorporated in the aggregate charge-generation layer, it is preferred (although not required) that the particular material selected is one which is incapable of generating any substantial number of electron-hole pairs when exposed to activating radiation for the co-crystalline complex of the charge-generation layer. In this regard, however, it has been found advantageous in accord with certain embodiments of the invention to incorporate a charge-transport material in the aggregate charge-generation layer which, although insensitive to activating radiation for the co-crystalline complex, e.g. visible light in the 520–700 nm. region, is sensitive to, or is capable of sensitizing the co-crystalline complex to, visible light in the 400–520 nm. region of the visible spectrum.

When a charge-transport material is incorporated in the charge-generation layer, the amount which is used may vary depending on the particular material, its compatibility, for example, solubility in the continuous polymeric binder of the charge-generation layer, and the like. Good results have been obtained using an amount of charge-transport material in the charge-generation layer within the range of from about 2 to about 50 weight percent based on the dry weight of the charge-generation layer. Larger or smaller amounts may also be used.

The multilayer photoconductive elements of the invention can be affixed, if desired, directly to a conducting substrate. In some cases, it may be desirable to use one or more intermediate subbing layers between the conducting substrate to improve adhesion to the conducting substrate and/or to act as an electrical barrier layer between the multi-active element and the conducting substrate as described in Dessauer, U.S. Pat. No. 2,940,348. Such subbing layers, if used, typically have a dry thickness in the range of about 0.1 to about 5 microns. Typical subbing layer materials which may be used include film-forming polymers such as cellulose nitrate, polyesters, copolymers of poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. A partial list of representative vinylidene chloride-containing polymers includes vinylidene chloride-methyl methacrylate-itaconic acid terpolymers as disclosed in U.S. Pat. No. 3,143,421. Various vinylidene chloride containing hydrosol tetrapolymers which may be used include tetrapolymers of vinylidene chloride, methyl acrylate, acrylonitrile, and acrylic acid as disclosed in U.S. Pat. No. 3,640,708. A partial listing of other useful vinylidene chloride-containing copolymers includes poly(vinylidene chloride-methyl acrylate), poly(vinylidene chloride-methacrylonitrile), poly(vinylidene chloride-acrylonitrile), and poly(vinylidene chloride-acrylonitrile-methyl acrylate). Other useful subbing materials include the so-called tergels which are described in Nadeau et. al. U.S. Pat. No. 3,501,301.

One especially useful subbing layer which may be employed in the multi-active element of the invention is a hydrophobic film-forming polymer or copolymer free from any acid-containing group, such as a carboxyl group, prepared from a blend of monomers or prepolymers, each of said monomers or prepolymers containing one or more polymerizable ethylenically unsaturated groups. A partial listing of such useful materials includes many of the above-mentioned copolymers, and, in addition, the following polymers: copolymers of polyvinylpyrrolidene and vinyl acetate, poly(vinylidene chloride-methyl methacrylate), and the like.

Optional overcoat layers may be used in the present invention, if desired. For example, to improve surface hardness and resistance to abrasion, the surface layer of the multiactive element of the invention may be coated with one or more electrically insulating, organic polymer coatings or electrically insulating, inorganic coatings. A number of such coatings are well known in the art and accordingly extended discussion thereof is unnecessary. Typical useful such overcoats are described, for example, in Research Disclosure, "Electrophotographic Elements, Materials, and Processes", Volume 109, page 63, Paragraph V, May, 1973, which is incorporated by reference herein.

The multi-active elements of the invention may be affixed, if desired, to a variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum and the like coated on paper or conventional photographic film bases such as cellulose acetate, polystyrene, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without electrical barrier layers are described in U.S. Pat. No. 3,245,833 by Trevoy, issued Apr. 12, 1966. Other useful conducting layers include compositions consisting essentially of an intimate mixture of at least one protective inorganic oxide and from about 30 to about 70 percent by weight of at least one conducting metal, e.g., a vacuum-deposited cermet conducting layer as described in Rasch, U.S. Pat. No. 3,880,657 issued Apr. 29, 1975. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. No. 3,007,901 by Minsk, issued Nov. 7, 1961 and 3,262,807 by Sterman et. al., issued July 26, 1966.

The following examples are included for a further understanding of the invention.

EXAMPLE 1

A layer of amorphous selenium was vacuum-deposited over a conductive support composed of a nickel-coated poly(ethylene terephthalate) film. A charge-generation layer of 15% (dry weight %) 4-p-dimethylaminophenyl-2,6-diphenylthiapyrylium perchlorate, and 85% (dry weight %) high viscosity polycarbonate was coated over the selenium layer with a 2-mil doctor blade from a 2% solution in methylene chloride. This layer was aggregated with an overcoat of toluene, using a 4-mil doctor blade, at 45° C. Finally, a charge-transport layer consisting of 40% (dry weight %) tri-p-tolylamine and 60% (dry weight %) Lexan® 145 was coated over the aggregate layer from a 13.5% solution in chloroform, with a 4-mil doctor blade, at 30° C. A similar element was prepared, without the selenium layer, as a control multiactive film. Photomicrographs of these films indicated that the thickness of the amorphous selenium layer was about 1 micron, while the aggregate charge-generation layer and transport layer thicknesses were 1.5 microns and 10 microns, respectively, for both the selenium-modified and the control multiactive film.

The electrophotographic response of both the multiactive selenium-containing photoconductor element of the invention and the control was measured using conventional techniques employing low-intensity continuous exposures. Table 1 lists the relative energy required to discharge the photoconductor elements. It can be seen from Table 1 that the sensitivity of the photoconductor element of the invention is greater than that of the control in the spectral range 400 nm to 600 nm and has equal sensitivity in the spectral range 600 nm to 700 nm.

Table 1

| Feature | Relative Energy to Discharge the Photoconductor Element from 500 volts to 100 volts | | | | | |
|---|---|---|---|---|---|---|
| | 400nm | 460nm | 500nm | 560nm | 600nm | 700nm |
| Control Multiactive element | 1* | 1* | 1* | 1* | 1* | 1* |
| Selenium Layer-containing Multiactive Element | 0.6 | 0.2 | 0.4 | 0.8 | 1.0 | 1.0 |

*Arbitrarily assigned a value of 1 in each column.

EXAMPLE 2

To demonstrate some of the various physical arrangements of the active layers contained in the multi-active elements of the invention, the following multi-active element was prepared. In this example, a charge generation layer similar to that described in Example 1 was coated over a nickel-coated poly(ethylene terephthalate) film support. The dry thickness of this charge-generation layer was about 1 micron. A layer of amorphous selenium was then vacuum deposited (at a pressure of about $4 \times 10^{-5}$ torr) onto the charge-generation layer to a thickness of about 0.1 micron. Finally, a charge-transport layer consisting of 40% (dry weight %) tri-p-tolylamine and 60% (dry weight %) Lexan® 145 was coated over the amorphous selenium layer to a thickness of about 15 microns. A similar multi-active element was prepared, without the selenium layer, as a control multi-active film.

The electrophotographic response of both the multi-active selenium-containing element of the invention and the control was measured using conventional techniques employing low-intensity continuous exposures. Table 2 lists the relative energy required to discharge both photoconductor elements. It can be seen from Table 1 that the sensitivity of the photoconductor element of the invention is greater than that of the control in the spectral range of from 400 to about 480 nm. The sensitivity of the multi-active element of the invention is less than that of the control in the 500 to 700 nm. spectral range. However, it should be noted that conventional single active layer and multi-active-layer aggregate-containing photoconductor elements normally exhibit a sensitivity peak or maximum in the 500 to 700 nm. spectral range, whereas these same elements normally exhibit, unless otherwise modified, a sensitivity minimum in the 400–500 nm. range. Accordingly, whereas it is definitely desired to increase the sensitivity of these aggregate-containing photoconductor elements in the 400 to 500 nm. spectral range, some decrease in sensitivity in the 500 to 700 nm. spectral although not preferred can be tolerated.

Table 2

| Feature | Relative Energy (ergs/cm²) to Discharge the photoconductor Element from 500 Volts to 100 Volts | | | | | | |
|---|---|---|---|---|---|---|---|
| | 400nm | 430nm | 460nm | 500nm | 560nm | 600nm | 700nm |
| Control Multi-active element | 1* | 1* | 1* | 1* | 1* | 1* | 1* |
| Selenium Layer containing multi-active element | 0.95 | 0.71 | 0.42 | 1.2 | 1.6 | 1.4 | 1.1 |

*Arbitrarily assigned a value of 1 in each column.

The invention has been described in detail with particular reference to certain preferred embodiments thereof, but it will be understood that variations and modifications can be effected within the spirit and scope of the invention.

We claim:

1. A photoconductive insulating element having at least three layers in electrical contact with one another, said layers comprising a charge transport layer coated over a photoconductive selenium-containing layer and a charge-generation layer, said charge-generation layer comprising a continuous electrically insulating polymer phase and dispersed in said continuous phase a discontinuous phase comprising a finely-divided, particulate co-crystalline complex of (i) at least one polymer having an alkylidene diarylene group in a recurring unit and (ii) at least one pyryliumtype dye salt, said co-crystalline complex, upon exposure to activating radiation for said complex, capable of generating and injecting charge carriers into said charge-transport layer, and said charge-transport layer being an organic composition free from said co-crystalline complex and said pyrylium-type dye salt, and comprising as a charge-transport material a p-type organic photoconductive material capable of accepting and transporting injected charge carriers from said charge-generation layer.

2. A photoconductive insulating element having at least three layers comprising a photoconductive selenium-containing layer in electrical contact with one surface of a charge-generation layer and the surface of said charge-generation layer opposite said selenium-containing layer being in electrical contact with a charge-transport layer, said charge-generation layer comprising a continuous, electrically insulating polymer phase and dispersed in said continuous phase a discontinuous phase comprising a finely-divided, particulate co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, and said charge-transport layer being an organic composition free from said co-crystalline complex and said pyrylium-type dye salt, and comprising as a charge-transport material a p-type organic photoconductive material capable of accepting and transporting injected charge carriers from said charge-generation layer.

3. A photoconductive insulating element having at least three layers comprising a photoconductive selenium-containing layer in electrical contact with one surface of a charge-generation layer and the surface of said charge-generation layer opposite said selenium-containing layer being in electrical contact with a charge-transport layer, said charge-generation layer comprising a p-type organic photoconductive charge-transport material in solid solution with a continuous, electrically insulating polymer phase and dispersed in said continuous phase comprising a finely-divided particulate co-crystalline complex of (i) at least one polymer having an alkylidene diarylene group in a recurring unit and (ii) at least one pyrylium-type dye salt, said co-crystalline complex, upon exposure to activating radiation for said complex, capable of generating and injecting charge carriers into said charge-transport layer, said charge-transport layer being an organic composition insensitive to said activating radiation and free from said co-crystalline complex and said pyrylium-type dye salt, said charge-transport layer comprising as a charge-transport material a p-type organic photoconductor material capable of accepting and transporting charge carriers from said charge-generation layer, and said photoconductive selenium-containing layer consisting essentially of vacuum-deposited selenium.

4. A photoconductive insulating element as defined in claim 3 wherein said charge-generation layer has a dry thickness less than about 15 microns, said pyrylium-type dye salt of said charge-generation layer comprises a thiapyrylium dye salt, said co-crystalline complex of said charge-generation layer exhibits photosensitivity to activating radiation within the wavelength range of from about 520 to about 700 nanometers, and said charge-transport layer has a dry thickness within the range of from about 5 to about 200 times that of said charge-generation layer.

5. A photoconductive insulating element as defined in claim 3 wherein said p-type charge-transport material contained in both said charge-generation layer and said charge-transport layer is a photoconductor selected from the group consisting of arylamine photoconductive materials and polyarylalkane photoconductive materials.

6. A photoconductive insulating element having at least four layers comprising a conductive support, a photoconductive selenium-containing layer in electrical contact with said conductive support, a charge-generation layer in electrical contact with one surface of said selenium-containing layer opposite said conductive support, and a charge-transport layer in electrical contact with one surface of said charge-generation layer opposite said selenium-containing layer, said conductive support being transparent to radiation within the range of from about 400 to about 700 nanometers, said photoconductive selenium-containing layer consisting essentially of vacuum-deposited selenium, said charge-generation layer having a dry thickness within the range of from about 0.5 to about 5.0 microns and comprising a p-type organic photoconductive charge-transport material in solid solution with a continuous electrically insulating polymer phase and dispersed in said continuous phase a discontinuous phase comprising a finely-divided particulate co-crystalline complex of (i) at least one polymer having an alkylidene diarylene group in a recurring unit and (ii) at least one thiapyrylium dye salt, said co-crystalline complex, upon exposure to radiation within the range of from about 520 to about 700 nanometers, capable of generating and injecting charge carriers into said charge-transport layer, said charge-transport layer being an electrically insulating organic composition having a dry thickness within the range of from about 10 to about 40 times that of said charge-generation layer, said charge-transport layer being free from said co-crystalline complex and any pyrylium-type dye salt and comprising as a p-type charge-transport material an organic photoconductive material having a principal absorption band below about 400 nanometers and capable of accepting and transporting injected charge carriers from said charge-generation layer.

7. A photoconductive insulating element as defined in claim 6 wherein said charge-transport material contained in said charge-generation layer and in said charge-transport layer is a p-type organic photoconductor selected from the group consisting of arylamine photoconductive materials and polyarylalkane photoconductive materials, and wherein said photoconductive selenium-containing layer has a thickness within the range of from about 0.001 to about 3 microns.

* * * * *